United States Patent [19]

Suzuki et al.

[11] Patent Number: 4,543,172

[45] Date of Patent: Sep. 24, 1985

[54] HIGH SPEED PLATING APPARATUS

[76] Inventors: Toshiyuki Suzuki, 4981-119 Uchino, Hamakita-shi, Shizuoka-ken; Hiroshi Tsukakoshi, 161-216 Tohshin-cho, Iwata-shi, Shizuoka-ken, both of Japan

[21] Appl. No.: 354,179

[22] Filed: Mar. 3, 1982

[30] Foreign Application Priority Data

Mar. 3, 1981 [JP] Japan ..... 56-30083
Mar. 3, 1981 [JP] Japan ..... 56-30084

[51] Int. Cl.[4] ..... C25D 17/12; C25B 9/00; C25B 11/04

[52] U.S. Cl. ..... 204/224 R; 204/272; 204/290 R; 204/293

[58] Field of Search ..... 204/224 R, 275, 272, 204/277, 290 R, 292, 293

[56] References Cited

U.S. PATENT DOCUMENTS

| | | | |
|---|---|---|---|
| 1,953,955 | 4/1934 | Crouch | 204/224 R X |
| 2,689,215 | 9/1954 | Bart | 204/224 R X |
| 2,764,540 | 9/1956 | Farin et al. | 204/272 X |
| 2,859,157 | 11/1958 | Curtiss, Jr. | 204/224 R X |
| 3,743,590 | 7/1973 | Roll | 204/272 X |
| 3,841,990 | 10/1974 | Sasaki et al. | 204/277 X |
| 4,171,255 | 10/1979 | Tuznik et al. | 204/238 |

FOREIGN PATENT DOCUMENTS 276921 9/1927 United Kingdom .

*Primary Examiner*—Donald R. Valentine
*Attorney, Agent, or Firm*—Donald D. Mon; Dave O'Reilly

[57] ABSTRACT

High speed plating apparatus in which a cylindrical electrode structure has fitted into it a metal tube. The metal tube has a higher melting point than the electrode, is corrosion resistant to plating liquid and protects the inner surface of the electrode.

7 Claims, 4 Drawing Figures

HIGH SPEED PLATING APPARATUS

DETAILED DESCRIPTION OF THE INVENTION

The present invention relates to a high speed plating apparatus for effecting an electric plating operation within a short time period in a plating chamber having a relatively small capacity with the use of a flowing plating liquid, and more particularly to the structure of an electrode to be disposed in that plating chamber.

BACKGROUND OF THE INVENTION

Generally speaking, an electric plating operation is composed of a pretreating step, a plating step and a posttreating step. We, the inventors, have proposed an apparatus of the type, in which a work to be plated is accommodated in a plating chamber having a relatively small capacity and equipped with an electrode acting as an anode and in which an electric current is applied between the electrode and the work while making a plating liquid flow in that plating chamber thereby to effect the plating operation within a short time period. In this high speed plating apparatus, a work having been pretreated is supported by a holder so that it is transferred into the plating chamber, and the holder holds the work and advances, while holding it, into the plating chamber until the aforementioned work is held in the plating chamber. That holder not only supports the work but also has a function as a current supply terminal or a cathode for applying an electric current to the work. Since the holder has a portion existing in the plating chamber, as has been described in the above, the portion facing the plating chamber is also plated if the current is applied between the electrode and the work. As a result, when the plating operation is repeated for a long time period, the thickness of the plated layer on the holder surface is gradually enlarged until the holder is so large in diameter that its advance and retraction in and out of the chamber may be impeded or that it will fail to release the work.

Prior to the aforementioned plating operation, on the other hand, the work is accommodated in a back-electrolyzing chamber having a construction similar to that of the plating chamber, in which it may have its surface etched. Since, in that back-electrolyzing chamber, the polarities of the anodes and cathodes are reversed between the electrode and the work, the holder in this case has its circumference back-electrolized, i.e., etched thereby causing a fear that the holder may be worn by the aforementioned etching treatment after a long use.

Another problem is that the aforementioned electrode is formed in a cylindrical shape as a portion of the circumferential wall of the plating chamber so that it may be corroded by the plating liquid flowing therein, i.e., a highly corrosive electrolytic liquid.

BRIEF DESCRIPTION OF THE INVENTION

The present invention has been conceived in view of the background thus far described and has as a first object to provide a high speed plating apparatus, in which the surface of the holder is prevented from being electrolytically treated or plated partly by holding a work and partly by coating the surface of an electrode for applying an electric current thereby with an electrically insulating material to attain a reliable and smooth operation for a long time period.

A second object of the present invention is to provide a high speed plating apparatus, in which the wear of the inner circumference of an electrode is prevented for a long time period and without fail by fitting a metal cylinder of platinum into the inner circumference of the electrode, which faces a plating chamber.

The present invention will be described in the following in connection with one embodiment thereof with reference to the accompanying drawings.

DETAILED DESCRIPTION OF THE INVENTION

Figure 1:
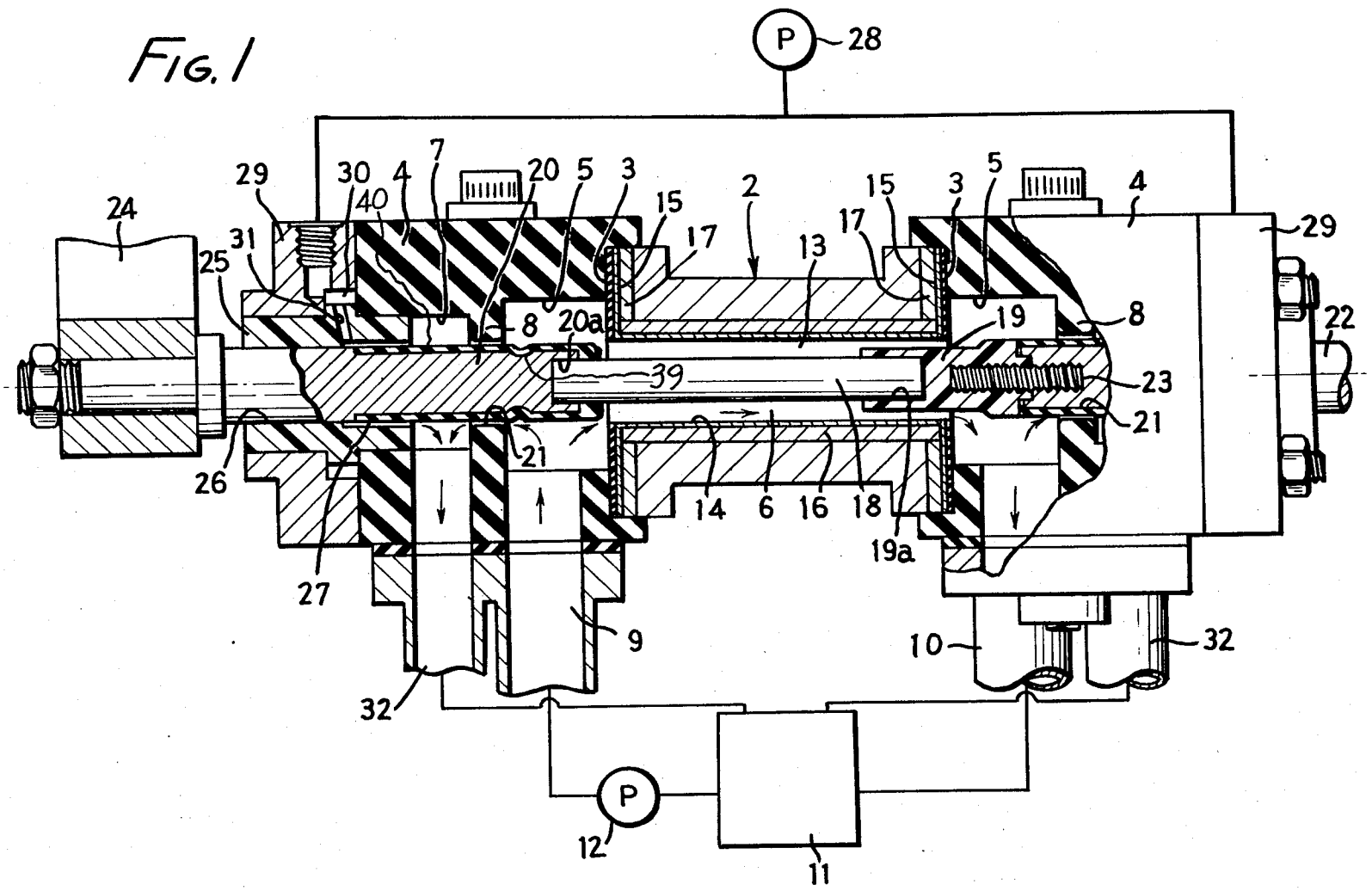
FIG. 1 is a partial sectional view of a high speed plating unit according to the invention.
Figure 2:
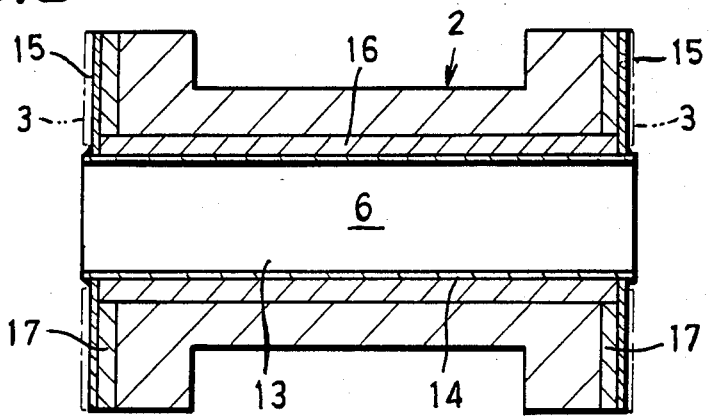
FIG. 2 is a sectional view of an electrode for the plating apparatus constructed according to the invention.

In the drawings, reference numeral 1 indicates a high speed plating unit which is disposed midway of a conveyor line connecting pretreating and posttreating baths (not shown). This high speed plating unit 1 is constructed of an electrode having a cylindrical shape, and a pair of end members 4 and 4 which are made of electrical insulating material and which close both open end portions of electrode 2 liquid-tight by means of gaskets 3 and 3. Those end members 4 and 4 have their facing sides formed with recesses 5 and 5 communicating with the hollow portion of the electrode 2 so that a plating chamber 6 is formed of the hollow portion of the electrode 2 and the communication recesses 5 and 5. As a result, the electrode 2 forms a portion of the circumferential wall of the plating chamber 6 and is electrically connected to provide an anode. On the other hand, the opposite end faces of the end members 4 and 4 are formed with mounting recesses 7 and 7 (only one of which is shown), separated from communication recesses 5 and 5 by partitions 8 and 8. Moreover, the communication recesses 5 and 5 communicate through an inlet passage 9 and an outlet passage 10 with a plating liquid reservoir tank 11, and the plating liquid in this tank 11 is pumped into the plating chamber 6 by the action of a pump 12. As a result, the plating liquid flows in the direction of the arrows into plating chamber 6, from which it is returned again through the outlet passage 10 into the plate liquid tank 11. Incidentally, the plating liquid in this embodiment is an electrolyte composed mainly of bichromic acid to produce the chromium plating operation.

Now, the aforementioned electrode 2 is made of copper, an alloy of copper and aluminum or the like, and a metal tube 14 having a predetermined thickness is axially press-fitted in the hollow portion 13 through plating liquid flows. That metal tube 14 is made of a platinum group consisting of platinum, indium, palladium and rhodium, or their alloys so that it has a higher melting point than the aforementioned electrode 2 and is excellent in corrosion resistance to the aforementioned plating liquid. On both the end faces of electrode 2, are mounted annular end plates 15 and 15 which are made of the same material as that of the aforementioned metal tube 14 and which are fixed by having their inner circumferential edges welded liquid-tight to the outer circumferences of both the ends of the metal tube 14. As a result, the portion of the electrode 2, facing plating chamber 6, is wholly covered with platinum or its alloy so that the plating liquid is blocked from directly contacting electrode 2. Moreover, protecting cylinder 16 is sandwiched between the inner circumference of the electrode 2 and the metal cylinder 14, and protecting end plates 17 and 17 are sandwiched between both the end faces of the electrode 2 and the end plates 15 and 15. Those protecting cylinder 16 and protecting end plates 17 and 17 are made of refractory steel such as Inconel and are interposed to prevent the electrode 2 from directly contacting metal cylinder 14 and the end plates 15 and 15. This prevents problems which could arise at a contact point of melting of electrode 2 or formation of an alloy of platinum of metal cylinder 14 and end plates 15,15 are welded together.

In the high speed plating unit 1 thus far described, there are fitted a pair of holders 19 and 20 for supporting a work 18 to be plated, which has been pretreated, in the aforementioned plating chamber 6. Incidentally, the work 18 in the present embodiment is shown in a long shape as a rod. The aforementioned holders 19 and 20 are axially arranged to face each other at a spacing inbetween so that they extend into the plating chamber 6 through holes 21 and 12 formed in mounting recesses 7 and 7 and in the partitions 8 and 8, respectively. Moreover, those holders 19 and 20 hold the work 18 such that they push on both the end portions of the work 18 and are formed at their leading opposite end faces with fitting recesses 19*a* and 20*a*, in which both the end portions of the work 18 can be fitted. One holder 19 is made of an electrically insulating material and is coaxially fixed to the leading end portion of the piston rod 22 of the cylinder through a stud bolt 23. Incidentally, the piston rod 22 may to extend through the plating chamber 6 and is coated on its circumference with a teflon resin. On the other hand, the other holder 20 is made of a conducting material and is fixed to a sliding block 24 which is reciprocally moved in the same direction as that of the aforementioned piston rod 22 by the action of a cylinder (not shown). Moreover, that holder 20 functions to chuck the work 18 and to provide an electrode acting as a cathode for applying an electric current to the work 18.

The holders 19 and 20 thus constructed are moved at a usual standby state to the outside (i.e., the lefthand side of the drawing) of the high speed plating unit 1 until they are arranged to face each other at a spacing through the aforementioned conveyor line. In this position piston rod 22 extends through the plating chamber 6. Moreover, when the work 18 fed from the pretreating step is held between the holders 19 and 20, these holders 19 and 20 approach each other so that both the end portions of the work 18 fit into recesses 19*a* and 20*a* of the holders 19 and 20. As a result, the work 18 is chucked between the holders 19 and 20. After that, the work 18 is axially moved toward the high speed plating unit 1 until it is held in position in the plating chamber 6 and is plated. Moreover, the holder 20 acting as the aforementioned electrode is coated with an electric insulator 40 on its surface facing the plating chamber 6 and the mounting recess 7. That electric insulator 40 is preferably made of a teflon resin. In the embodiment being described, however, the electric insulator 40 is not prepared merely by the coating process but is mounted on the holder 20 by axially fitting a cylinder, which is formed in advance to have a predetermined thickness, in a circumferential groove 39 formed in the circumference of the aforementioned holder 20 adjacent plating chamber 6.

In the mounting recesses 7 and 7 of the aforementioned end members 4 and 4, on the other hand, there are fitted, respectively, plug members 25 (only one of which is shown), which are formed with guide holes 26 and 26 for guiding the holders 19 and 20. Those guide holes 26 and 26 are slightly enlarged at the sides of the mounting recesses 7 and 7 to form gaps 27 between themselves and the outer circumferences of the holders 19 and 20 as merge into the mounting recesses 7 and 7. At the outer sides of the plug members 25 and 25, there are fixed air guides 29 and 29 which lead to an air pump 28, and air passages 30 and 30 (only one of which is shown). That air passage 30 communicates through a guide hole 31 with the aforementioned gap 27 so that, if air under high pressure is supplied from the air pump 28, the high pressure air is blown through the gap 27 onto the outer circumference of the holder 20 or the piston rod 22 thereby blowing away the plating liquid wetting that extending into the mounting recesses 7 and 7. Incidentally, the plating liquid thus blown away is returned through ducts, 32 and 32 into the aforementioned plating liquid reservoir tank 11. By that air supply, on the other hand, the insides of the mounting recesses 7 and 7 are maintained at higher pressure than that in the plating chamber 6 so that the plating liquid is prevented from flowing out into the mounting recesses 7 and 7 through the clearances between the holder 20 or the piston rod 22 and the through holes 21 and 21.

Incidentally, the holder 20 is made of a corrosion resistive conducting material but has its surface either plated or coated with the teflon or the like except the inside of its recess 20 and the portion contacting sliding block 24.

According to the construction thus far described, the holder 20 for chucking the work 18 and for acting as the cathode for applying the electric current to work 18 is positioned in the plating chamber 6 when in the plating operation and is coated with the electric insulator 40 on its surface exposed to plating chamber 6 and the mounting recess 7. As a result, no electric current is applied between that holder 20 and the surface of electrode 2 so that the holder 20 is left unplated. Even if the plating operation is repeated for a long time period, therefore, there arises no fear that the holder 20 may be plated to have its diameter enlarged arises so that it can smoothly move in the high speed plating unit 1. Moreover, since the electric insulator 40 is formed into such a cylindrical shape as to have a predetermined thickness, it is not easily removed within a short time period by the flowing plating liquid. In case the electric insulator 40 deteriorates after use for a long time period, still moreover, the electric insulator 40 be removed from the circumferential groove and replaced by a new one by inserting the latter. As a result, the holder 20 can be economically used as it is.

Incidentally, the work is held in position prior to the aforementioned plating operation in a back-electrolyzing chamber having a construction similar to that of the plating chamber. That back-electrolyzing chamber has its electrode and holder reversed in polarity between the anode and the cathode so that the work surface is back-electrolyzed or etched. In this case, the holder is coated with an electric insulator on its surface facing the back-electrolyzing chamber, prevented from being worn by the etching process. Therefore, the present invention can be applied not only when the work is to be electrically plated but also similarly when the work is to be etched.

On the other hand, since the inner circumference and both the end faces of the electrode 2, which face the plating chamber 6, are coated with the metal cylinder 14 and the end plates 15 and 15, which are made of one element of the platinum group or its alloy, the electrode 2 can be prevented from being exposed to the highly corrosive plating liquid. Even if the plating operation is repeated for a long time period, therefore, corrosion of the electrode 2 can be prevented thereby improving durability. Since the metal tube 14 and the end plates 15 and 15 are made to have a predetermined thicknesses, they are free of any fear of removal within a short time period by the flowing plating liquid, as in the case in which they are merely coated with a thin film of platinum, so that they can endure elongated use. Furthermore, since the metal tube 14 is mounted merely by being press-fitted in the hollow portion 13 of the electrode 2, there can be attained the advantage that it can be attached easily.

Figure 3:
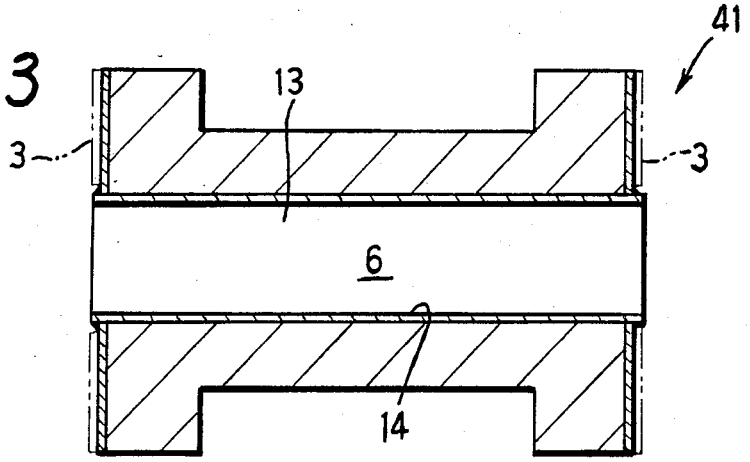
FIG. 3 is a sectional view showing a modification of the electrode of FIG. 2.

As to the above construction, incidentally, the present invention should not be limited to the embodiment thus far described but can be practised as shown in FIG. 3. In this embodiment, an electrode 41 itself is made of refractory steel such as Inconel or stainless steel and is covered with the metal tube 14 and the end plates 15 and 15, both similar to the foregoing first embodiment, on its inner circumference and both its end faces facing that plating chamber 6 respectively. According to the embodiment thus modified, there can be attained the advantage that the electrode 41 can have its construction simplified so that its cost can be reduced.

Figure 4:
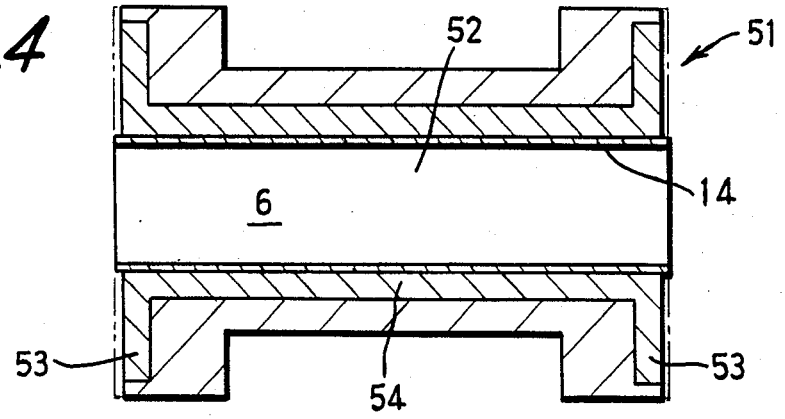
FIG. 4 is a sectional view showing a further modification of the electrode of FIG. 2.

In accordance with a modification shown in FIG. 4, on the other hand, an electrode 51 is made of copper, an alloy of copper and aluminum or the like, and there is integrally cast the hollow portion 52, of that electrode 52. A protecting member 54 made of lead or an alloy of lead and zinc, which is formed with such flanged portions 53 and 53 to cover not only the inner circumference but also both the end faces of that electrode 51 and into which the metal tube 14 is press-fitted. According to the modification thus constructed, since both the end faces of the electrode 51, which face the plating chamber 6, are covered with the flanged portions 53 and 53 of the protecting member 54, the end plates made of precious platinum can be dispensed with, and the welding operation of the metal tube 14 and the end plates can also be eliminated simplifying their assembly. As a result, there can be attained the advantage that production costs can be remarkably reduced.

What is claimed is:

1. In a high speed plating apparatus having a plating chamber equipped with electrodes the improvement comprising:

one of said electrodes being cylindrical to form a cylindrical plating chamber;

a metal tube fitted into said cylindrical electrode between the inner surface of said cylindrical electrode and said plating chamber formed thereby;

said metal tube being comprised of an alloy of platinum having a higher melting point than said electrode and being corrosion resistant to a plating liquid whereby said metal tube covers and protects the inner circumferential surface of said one electrode.

2. The apparatus according to claim 1 in which the ends of said one electrode is covered with plates of the same material as said metal tube.

3. The apparatus according to claim 2 in which said metal plates are joined to said metal tube.

4. The apparatus according to claim 1 including a protecting cylindrical tubular member interposed between said one electrode and said metal tube.

5. The apparatus according to claim 4 in which said protecting cylinder has integrally formed end plates.

6. The apparatus according to claim 5 in which said protection cylinder is comprised of a refractory steel.

7. The apparatus according to claim 4 in which said protecting cylinder is comprised of a refractory steel.

* * * * *